United States Patent [19]

Dunne

[11] 3,968,538

[45] July 13, 1976

[54] DOUBLE SUCTION UNIT

[75] Inventor: Owen F. Dunne, Tiverton, R.I.

[73] Assignee: Clevepak Corporation, New York, N.Y.

[22] Filed: Sept. 30, 1974

[21] Appl. No.: 510,573

Related U.S. Application Data

[62] Division of Ser. No. 449,082, March 7, 1974, Pat. No. 3,853,079.

[52] U.S. Cl. ..... 15/409; 417/174

[51] Int. Cl.[2] ..... A47L 5/18

[58] Field of Search ..... 15/409; 417/174

[56] References Cited

UNITED STATES PATENTS

| | | | |
|---|---|---|---|
| 1,817,337 | 8/1931 | Baker | 15/409 X |
| 2,923,959 | 2/1960 | Huber | 15/409 X |
| 3,352,348 | 11/1967 | Daviau | 417/174 X |
| 3,442,086 | 5/1969 | Nieman | 417/174 X |
| 3,558,240 | 1/1971 | Snodgrass | 417/174 |

FOREIGN PATENTS OR APPLICATIONS

| | | | |
|---|---|---|---|
| 489,862 | 1/1954 | Italy | 15/409 |

*Primary Examiner*—Leonard D. Christian
*Assistant Examiner*—C. K. Moore
*Attorney, Agent, or Firm*—Cushman, Darby and Cushman

[57] ABSTRACT

An apparatus for removing both cut threads and trimmed edges from the working area of a sewing machine with a unit having a first air passage coupled to the area for removing trimmed edges, a second air passage coupled to the area for removing trimmed edges and opening into the first passage at an acute angle in an elliptically shaped opening to inject an air stream into the first passage to transfer momentum and cause air flow, the second passage comprising two tubular members one inside the other with the outer opening into the first passage, and a third air passage injecting air at a pressure above atmospheric pressure at an angle in an elliptically shaped opening to transfer momentum and create air flow through said second passage.

7 Claims, 3 Drawing Figures

40
42
60
62
64
66
58
38
24
120°
26
28
31

DOUBLE SUCTION UNIT

This is a division of application Ser. No. 449,082, filed Mar. 7, 1974, now U.S. Pat. No. 3,853,079.

BRIEF DESCRIPTION OF THE PRIOR ART AND SUMMARY OF THE INVENTION

The invention relates to an apparatus for removing with suction both cut threads and trimmed edges from the working area of a sewing machine.

Some commercial sewing machines are provided with a chain cutter which cuts the leading and trailing ends of thread on the sewing machine. Such cutter may be actuated manually by the operator of the machine or automatically in response to signals generated by sensors which detect the position of the garment being sewn. It is conventional to draw the leading edge of the chain into a tube with suction so that the chain is kept taut and easy to cut and so that the cut threads can be penumatically conveyed to a waste container for easy disposal.

Further, sewing machines of the type commonly referred to as "overlock" and/or "safety stitch" are provided with side cutting knives which trim off eneven edges of the cloth so that the overlock stitch covers the seams of the two or more parts that are sewn together. This trimmed off portion generally falls in a basket, on the floor or in the operator's lap. At the end of the day these scraps are then usually swept up for disposal. It has also been suggested in the past to use a separate suction system for removing the trimmed cloth edges.

The present invention relates to an apparatus which can be used for removing both the cut threads and the trimmed edges from the working area of a sewing machine. As in previous systems, air from a source above atmospheric pressure is injected into an air passage which has an inlet coupled to the region adjacent where the chain is being cut to create flow of an air stream through the passage and suction which pulls the chain through the unit. However, this air stream, created by injection of the air at a pressure above atmospheric pressure is, according to the invention of this application, injected into a further passage which is coupled to the region adjacent where cloth edges are being cut so that the normally wasted air from the exhaust end of the chain cutter unit is employed to create a vacuum to remove waste trimmings from the cloth. The outlet of the passage into which the air stream carrying the cut threads is injected is then coupled to a waste container for collecting both the cut threads and cut edges for disposal.

In the embodiment of the invention described in detail below, the unit which includes the above mentioned passages is comprised of a first straight passage, the inlet of which is connected pneumatically to the area for removing cut edges and a second passage which opens into the first passage between the inlet and outlet thereof at an acute angle of preferably 22°. The inlet of the second passage is coupled pneumatically to the area for removing chains. A third passage in turn opens into the second passage between the inlet and outlet thereof and is coupled to a source of air above atmospheric pressure, for example the air supplied normally in the environment of a sewing factory. The second passage includes a first portion into which the air from the third passage is injected at an angle preferably of 22° and a second portion comprising an outer tubular member which opens into the first passage and an inner tubular member which guides the air stream passing through the second passage and ends adjacent the opening of the outer tubular member into the first passage, without butting into the first passage. The use of the inner and outer tubular members has been found to be substantially responsible for the effective momentum transfer into the first passage and the resultant suction which draws the cut ends through the unit into the waste container attached to the outlet of the first passage.

Many other objects and purposes of the invention will become clear from the following detailed description of the drawings.

DETAILED DESCRIPTION OF THE DRAWINGS

Figure 1:
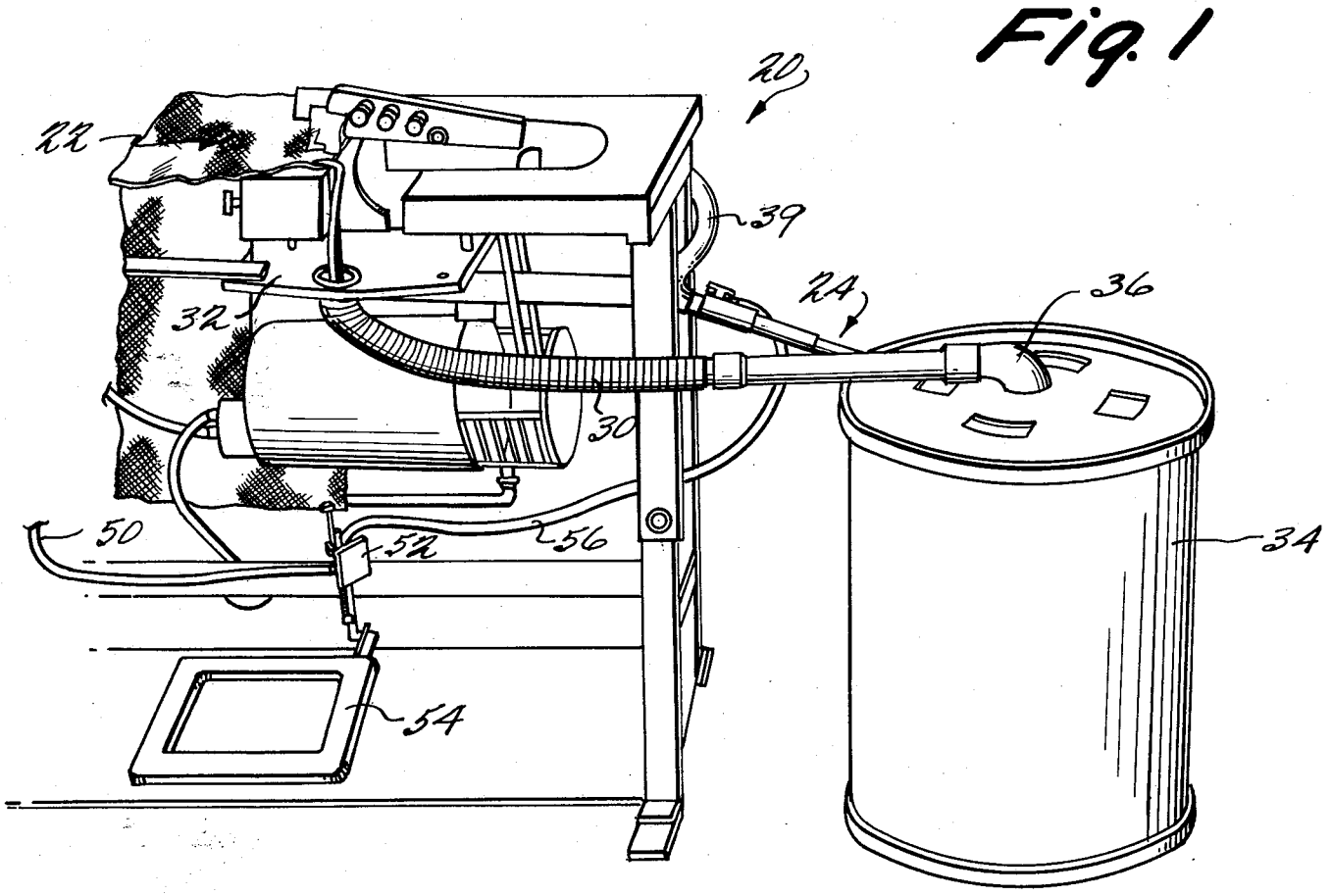
FIG. 1 shows a perspective view of the invention of this application mounted in conjunction with a sewing machine.
Figures 2, 3:
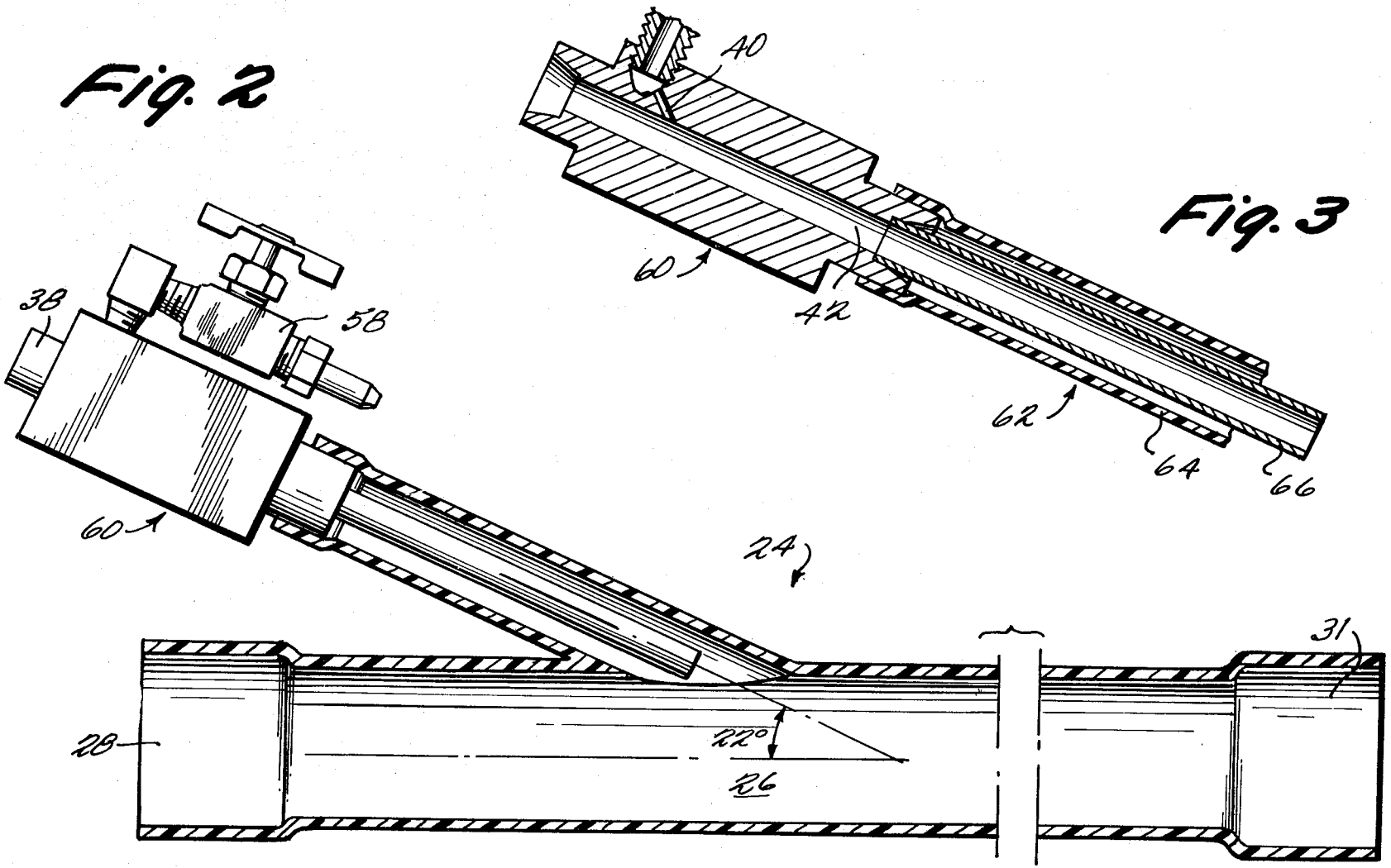
FIG. 2 shows a partial sectional view of the unit of which defines the first, second and third passages.
FIG. 3 shows a sectional view of the portion of the unit of FIG. 2 defining the second and third passages.

Reference is now made to FIG. 1 which shows a perspective view of the invention of this application in use on a sewing machine. Machine 20 in FIG. 1 is a conventional overlock and/or safety stitch machine which includes a conventional mechanism indicated generally as 22 for cutting the edges of the cloth. Machine 20 also includes a conventional chain cutter (not shown in FIG. 1) for removing the cut chain stitches. The embodiment illustrated in FIG. 1 includes a unit 24 which is illustrated in sectional view in FIG. 2. Referring to FIG. 2, unit 24 defines a first passage 26 between an inlet 28 and an outlet 31. Inlet 28 is connected to conventional flexible or rigid hose 30 which in turn is disposed by a mounting 32 in the region where the cut edges of the garment are being produced so that the edges are drawn into hose 30 and through that hose and passage 26 to waste container 34 which is coupled by L-shaped coupling member 36 to the outlet 31 of passage 26.

Unit 24 also includes a second passage with an inlet 38 connected by a flexible hose 39 to a conventional chain cutter of sewing machine 20 (not shown). A third air passage 40, which can be seen in FIG. 3, injects an air stream at an acute angle, preferably 22°, into second passage 42, transferring momentum to the air in that passage and creating an air stream which flows from the inlet toward the outlet of the second passage 42, creating a suction which pulls the cut chains into hose 39 and, after they are cut, through hose 39 and second passage 42 to be injected into first passage 26 and thereafter conveyed with the air stream in that passage to the outlet 31 and waste container 34.

The air stream which is injected via the third passage 40 is supplied from conventional source, for example, the factory air supply. In the arrangement of FIG. 1, the air supply is connected via hose 50 to a treadle valve 52 which is operated by a conventional sewing machine treadle 54 to couple and uncouple hoses 50 and 56. Hose 56 is connected to needle valve 58 of unit 24 as can be best seen in FIG. 2. When needle valve 58 is open and the treadle valve 52 is actuated by operation of treadle 54 by the machine operator, an air stream is injected into second passage 42 via third passage 40 at an acute angle of 22 degrees to transfer momentum to the air in passage 42 and create air flow.

Second air passage 42 is comprised of a first portion 60 into which the third passage 40 opens and a second portion 62. Second portion 62 includes a pair of concentric cylindrical tubular members 64 and 66 with member 66 extending within member 64 as illustrated and guiding air flow in second passage 42. Member 64 opens into the first passage 26 in an elliptically shaped, flat opening. Member 66 terminates adjacent the elliptically shaped opening without butting into passage 26 to create a particularly advantageous configuration for efficiently transferring momentum. The angle of the injection between the first passage 26 and the second passage 42 is preferably 22° in the embodiments of FIGS. 1–3. The inner tubular member 66 is preferably constructed of aluminum while the outer tubular member 64 and the remainder of the structure defining unit 24 are preferably made of plastic which may be painted or otherwise colored as desired. Needle valve 58 is preferably a conventional metal needle valve.

Many changes and modifications in the above described embodiment of the invention can be of course be carried out without departing from the scope thereof. Accordingly, that scope is intended to be limited only by the scope of the appended claims.

What is claimed is:

1. A dual suction apparatus having a first air passage extending from a first open inlet for receiving material to be transported to an outlet, a second air passage separate from said first passage and extending from a second open inlet for also receiving material to be transported to an outlet opening into said first passage between the inlet and outlet thereof, a third air passage extending from an inlet to an outlet opening into said second passage between the inlet and outlet thereof at such an angle so as to inject an air stream at a pressure above atmospheric pressure into said second passage to transfer momentum to the air therein, and to cause air to flow between the inlet and outlet of said second passage, said air flow in said second passage being injected into said first passage at such an angle so as to transfer momentum to the air therein to cause air to flow between the inlet and outlet of said first passage, and means coupled to said inlet of said third passage for supplying said air stream at a pressure above atmospheric pressure.

2. Apparatus as in claim 1 wherein said third air passage opens into said second passage in an elliptically shaped opening flat with the interior surface of said second passage.

3. Apparatus as in claim 1 wherein said first and second passages are circular in cross section and straight.

4. Apparatus as in claim 1 wherein said second passage includes a first portion with said third passage opening into said first portion and a second portion with a first tubular member opening into said first passage in an elliptically shaped opening flat with the interior surface of said first passage, and a second tubular member within said first member conveying said air flow from said first portion to the opening of said first tubular member into said first passage.

5. Apparatus as in claim 1 wherein said angles are each 22°.

6. An apparatus as in claim 1 wherein said second passage opens into said first passage at an acute angle to the direction of air flow from said first open inlet.

7. An apparatus as in claim 6 wherein said third passage opens into said second passage at an acute angle to the direction of air flow from said open inlet.

* * * * *